United States Patent [19]

Lohr

[11] 3,999,771

[45] Dec. 28, 1976

[54] GALLOPING RIDING HORSE

[76] Inventor: Raymond J. Lohr, 5043 Sterrettania Road, Erie, Pa. 16506

[22] Filed: Nov. 28, 1975

[21] Appl. No.: 635,583

[52] U.S. Cl. ..... 280/1.13; 272/53.2

[51] Int. Cl.[2] ..... A63G 17/00

[58] Field of Search ..... 272/53.2, 52, 52.5, 272/53.1; 280/1.13, 1.181, 1.182, 1.184, 1.189, 1.191, 1.192, 1.194, 1.195, 1.201, 1.202, 1.203, 1.208, 3, 218

[56] References Cited

UNITED STATES PATENTS

| | | | |
|---|---|---|---|
| 1,977,317 | 10/1934 | Maypole | 280/218 |
| 2,668,579 | 2/1954 | Swengel | 272/52 |
| 2,738,199 | 3/1956 | Rand | 280/1.182 |
| 2,768,833 | 10/1956 | Sidoff | 280/1.189 X |
| 3,096,990 | 7/1963 | Thoren | 280/1.182 |
| 3,229,995 | 1/1966 | Grieder | 280/218 |
| 3,423,105 | 1/1969 | Kerstholt et al. | 280/218 |

FOREIGN PATENTS OR APPLICATIONS

| | | | |
|---|---|---|---|
| 508,057 | 7/1920 | France | 280/1.182 |
| 463,111 | 7/1928 | Germany | 280/1.195 |
| 604,622 | 10/1934 | Germany | 280/1.182 |
| 469,278 | 7/1937 | United Kingdom | 280/1.195 |

*Primary Examiner*—Paul E. Shapiro
*Assistant Examiner*—Arnold W. Kramer

[57] ABSTRACT

A riding toy made up of a hollow simulated horse body having a generally inverted U-shaped axle suspension member supported at its rear end with wheels on the legs of the inverted U-shaped suspension member and a front wheel with handle bar attached to the horse's head. When a rider bounces up and down on the horse, the action of the suspension member gives the impression of a galloping horse.

8 Claims, 5 Drawing Figures

GALLOPING RIDING HORSE

OBJECTS OF THE INVENTION

It is an object of the invention to provide an improved toy horse.

Another object of the invention is to provide an improved toy vehicle.

Another object of the invention is to provide a toy vehicle that will give the impression of a galloping horse that is simple in construction, economical to manufacture and simple and efficient to use.

With the above and other objects in view, the present invention consists of the combination and arrangement of parts hereinafter more fully, described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF DRAWINGS

DETAILED DESCRIPTION OF DRAWINGS

Figure 1:
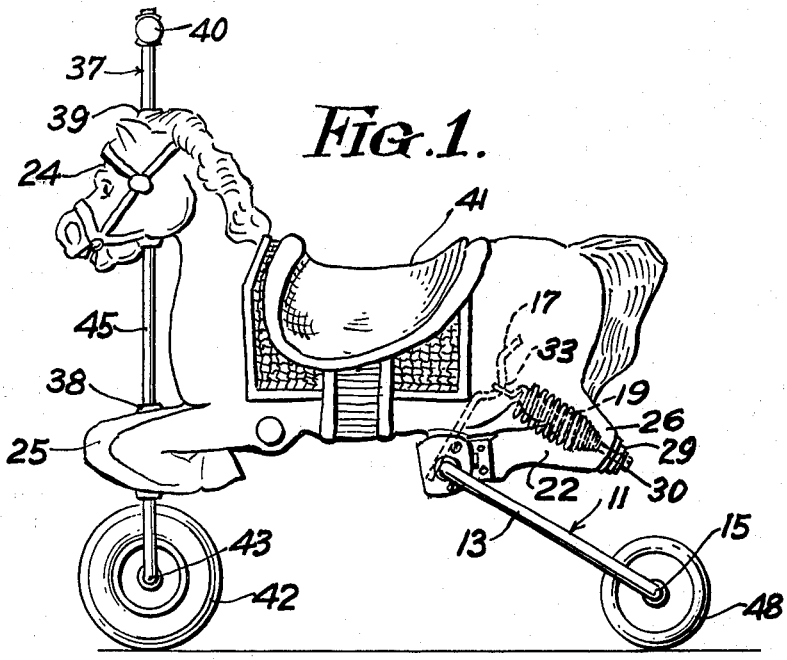
FIG. 1 is a side view of the horse according to the invention.
Figure 2:
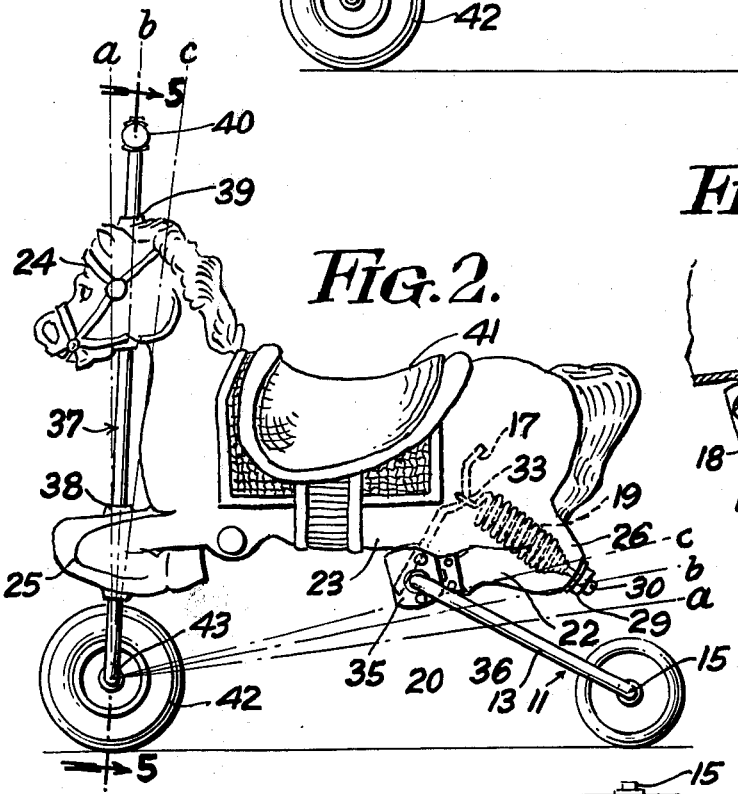
FIG. 2 is a view similar to FIG. 1 showing the manner in which the horse body rocks about the front axle.
Figure 4:
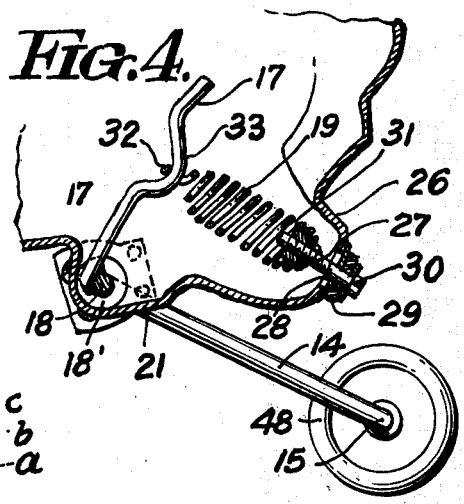
FIG. 4 is an enlarged view showing the invention mechanism.
Figure 3:
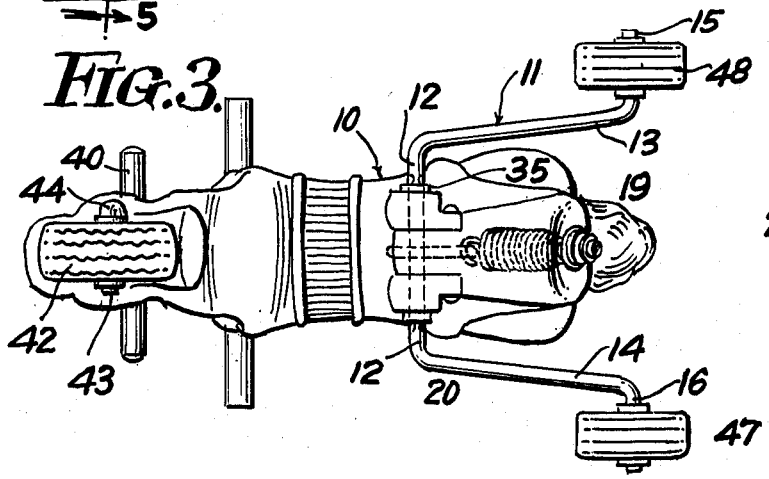
FIG. 3 is a bottom view of the vehicle shown in FIGS. 1 and 2.
Figure 5:
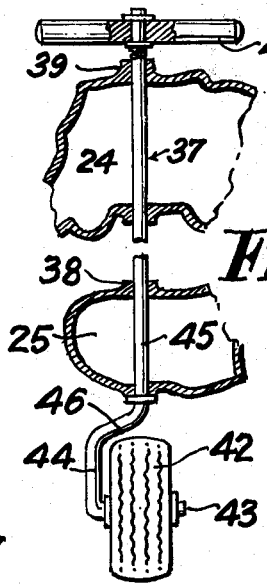
FIG. 5 is a cross-sectional view taken on lines 5—5 of FIG. 2.

Now, with more particular reference to the drawings:

A toy horse that gives the impression of a galloping horse is shown having a body 10. The body has a generally U-shaped suspension member 11 supported on the rear end of the body and the U-shaped suspension member has an intermediate part 12 and two downwardly extending outwardly diverging legs 13 and 14 integrally fixed with it. Member 11 can be made of a single rod. Axles 15 and 16 are fixed to the lower end of the legs 13 and 14. A crank member 17 is welded to the intermediate member 12 at 18 and extends upwardly therefrom at approximately right angle to the legs 13 and 14. The crank 17 extends through an eye in the spring 19 and the rear end of the spring 19 extends into the cavity formed by the knees 26 of the horse and a screw 27 passes through an opening 28 and has a washer 29 disposed under the head 30 of the screw. The screw 27 has a threaded nut 31 threaded thereon by which the position of the rear end of the spring 19 can be located. The rod 17 passes through the eye 32 of the spring 19 and the crank 17 has a curved portion 33 that prevents the spring from slipping.

The bearing member 20 may be made of nylon or some other self-lubricating material and it is attached to the flanges 35 which are formed on the bearing member 20. The flanges are held to the body of the horse by screws 36 on each side of the cavity formed in the horse's hooves or legs 22 which rest against the underbelly 23 of the horse's body.

The front legs 25 are integral with the body of the horse and a handlebar 37 passes through a bearing 38 in the horse's front leg and up through a bearing member 39 into the horse's head and terminates in the handle 40.

When a child sits in the saddle 41 and bounces up and down, the suspension member 13 will rock about its intermediate member and the entire body will rock about the front axle deflecting the spring 19. The seat always returns to the same starting height regardless of tension of spring. The tension spring 19 and, therefore, the rear end of the horse, can be adjusted by adjusting the screw 30. The tension of the spring can therefore be adjusted in a very simple manner by means of a simple screwdriver. The front wheels 42 is supported on the front axle 43. The axle is bent perpendicular to the portion 44 of the handle. Lower vertical portion 44 is parallel to the upper vertical portion 45 and connected thereto by the downwardly inclined portion 46. Thus, the entire handle bar 37 can be made by bending a piece of rod to form the portions 44, 45 and 46 and the axle 43. The upper end can be passed through a bore 47 in handle 40 with a suitable fastener placed on top to hold the handle in place. Instead of the single steerable front wheel, a single fixed wheel could be used, or, two fixed wheels for the smaller child.

The foregoing specification sets forth the invention in its preferred practical form but the structure shown is capable of modification within a range of equivalents without departing from the invention which is to be understood is broadly novel as is commensurate with the appended claims.

The embodiments of the invention in which an exclusive property or privilege is claimed are defined as follows:

1. A riding toy vehicle comprising, a generally hollow body having downwardly depending side walls, a generally inverted U-shaped suspension member having a straight intermediate part with downwardly and outwardly extending legs terminating in ground-engaging wheel means, said straight intermediate part passing through the body and being pivotally supported by bearing flanges carried by the bottom portion of the body at a location to the rear of the mid-portion thereof with the plane of the member extending downwardly and rearwardly from the body, a crank member fixed to said intermediate part and extending up into said body approximately perpendicular to said plane, an adjustable tension spring in said body substantially parallel to said plane, means attaching the forward end of said spring to said crank member and means attaching the rear end of said spring to said body, one of said attaching means being adjustable for tensioning said spring, and front wheel means mounted on the lower portion of a substantially vertical steering rod, said steering rod being pivotally mounted through the front portion of said body and pivotal about its vertical axis.

2. A riding toy comprising a generally hollow body having downwardly depending side walls, a generally inverted U-shaped suspension member having a straight round intermediate part with downwardly and outwardly extending legs terminating in ground-engaging wheel means, said round straight intermediate part passing through the body and being pivotally supported by bearing flanges carried by the bottom portion of the body at a location to the rear of the mid-portion thereof with the plane of the member extending downwardly and rearwardly from the body, a crank member fixed to said intermediate part and extending upwardly and rearwardly into said body approximately perpendicular to said plane, an adjustable tension spring in said body substantially parallel to said plane, means attaching the forward end of said spring to said crank member and means attaching the rear end of said spring to said body, one of said attaching means having means thereon disposed on the outside of said body which is adjustable for tensioning said spring, and means on said body for supporting the front end of said body on a floor.

3. The toy recited in claim 2 wherein said bearing flanges comprise bearing members fixed to said body and said intermediate part is rotatably received in said bearing members with said means supporting the front of said body comprising a front wheel.

4. The toy recited in claim 3 wherein said body has a laterally extending recess at its lower part and said bearing members are disposed in said recess, said bearing members being fixed to said body around said recess.

5. The toy recited in claim 4 wherein said toy is in the shape of a horse and said body has rear legs with hooves and a belly and front legs generally horizontal and its hooves are supported against said belly, and said recess receiving said bearing members is in said hooves.

6. The toy recited in claim 5 wherein said rear legs have knees defining another recess, and said spring extends downwardly and outwardly and received in said another recess.

7. The toy recited in claim 6 wherein said extension member is a round resilient rod.

8. The toy recited in claim 7 wherein said front legs have knees, and a head overlies said front legs, and a steering rod extends down through said head and through said knees and terminates in an axle, and said front wheel is mounted on said axle.

* * * * *